US010294782B2

(12) United States Patent
Murphree et al.

(10) Patent No.: US 10,294,782 B2
(45) Date of Patent: May 21, 2019

(54) FLUIDIC PULSER FOR DOWNHOLE TELEMETRY

(71) Applicant: Halliburton Energy Services, Inc., Houston, TX (US)

(72) Inventors: Zachary Ryan Murphree, Dallas, TX (US); Frederic Felten, Corinth, TX (US); Thomas Jules Frosell, Irving, TX (US); Michael Linley Fripp, Carrollton, TX (US); Vimal Shah, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/029,779

(22) Filed: Jul. 9, 2018

(65) Prior Publication Data

US 2018/0313212 A1 Nov. 1, 2018

Related U.S. Application Data

(62) Division of application No. 15/118,004, filed as application No. PCT/US2014/027141 on Mar. 14, 2014, now Pat. No. 10,041,347.

(51) Int. Cl.
*E21B 47/18* (2012.01)
*F15C 1/16* (2006.01)
(Continued)

(52) U.S. Cl.
CPC ..... *E21B 47/182* (2013.01); *E21B 47/12* (2013.01); *E21B 47/14* (2013.01); *E21B 47/18* (2013.01);
(Continued)

(58) Field of Classification Search
CPC ..... E21B 47/12; E21B 47/14; E21B 47/18; E21B 47/182; E21B 47/185; F15C 1/16; Y10T 137/2087
See application file for complete search history.

(56) References Cited

U.S. PATENT DOCUMENTS 4,291,395 A 9/1981 Holmes
4,323,991 A 4/1982 Holmes et al.
(Continued)

FOREIGN PATENT DOCUMENTS

EP 304988 A1 3/1989
WO 2015/102575 A1 7/2015

OTHER PUBLICATIONS

International Search Report and Written Opinion issued in related PCT Application No. PCT/US2014/027141 dated Dec. 12, 2014, 16 pages.
(Continued)

*Primary Examiner* — Andrew W Bee
(74) *Attorney, Agent, or Firm* — Alan Bryson; Baker Botts L.L.P.

(57) ABSTRACT

An example method includes providing fluid communication between an internal bore of a drill string and an annulus between the drill string and a borehole through a fluid channel in a side of a collar coupled to the drill string. Fluid may be circulated through the internal bore of the drill string. A fluid telemetry signal may be generated by selectively generating a vortex within the fluid channel. Providing fluid communication between the internal bore and the annulus through the fluid channel may include providing fluid communication between the internal bore and a vortex basin at least partially defining the fluid channel, through at least one of a first fluid flow path and a second fluid flow path between the vortex basin and the internal bore; and
(Continued)

providing fluid communication between the vortex basin and the annulus through a fluid outlet of the vortex basin.

11 Claims, 13 Drawing Sheets

(51) Int. Cl.
*E21B 47/12* (2012.01)
*E21B 47/14* (2006.01)

(52) U.S. Cl.
CPC ..... *E21B 47/185* (2013.01); *E21B 47/187* (2013.01); *F15C 1/16* (2013.01)

(56) References Cited

U.S. PATENT DOCUMENTS 4,391,299 A 7/1983 Holmes
4,418,721 A 12/1983 Holmes
4,557,295 A 12/1985 Holmes
5,893,383 A * 4/1999 Facteau ..... B05B 1/08 137/14
7,404,416 B2 * 7/2008 Schultz ..... F15C 1/22 137/835
8,678,035 B2 3/2014 Fripp et al.
9,133,685 B2 * 9/2015 Fripp ..... E21B 34/08
2006/0109141 A1 5/2006 Huang et al.
2011/0011594 A1 1/2011 Young et al.
2011/0077594 A1 3/2011 Kriesel et al.
2012/0292015 A1 11/2012 Schultz et al.
2014/0231095 A1 8/2014 Lopez et al.
2015/0034386 A1 2/2015 Reed et al.

OTHER PUBLICATIONS

"Development of High Data Rate Vortex Throttle Mud Pulse Telemetry Transmitters for Measurement-While-Drilling Applications," Defense Research Technologies, Inc., DRT Technical Report No. DR-051, May 1992, 57 pages.
Wasserman, Ingolf, et al. "Mud-pulse telemetry sees step-change improvement with oscillating shear valves." Oil & Gas Journal 106.24 (2008).
International Preliminary Report on Patentability issued in related Application No. PCT/US2014/027141, dated Sep. 22, 2016 (13 pages).

* cited by examiner

FLUIDIC PULSER FOR DOWNHOLE TELEMETRY

CROSS-REFERENCE TO RELATED APPLICATIONS

This application claims priority to and is a divisional application of U.S. application Ser. No. 15/118,004 filed on Aug. 10, 2016 entitled "Fluidic Pulser for Downhole Telemetry," which is a National Stage application of International Application No. PCT/US2014/027141 filed Mar. 14, 2014, both of which are incorporated herein by reference in their entirety for all purposes.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation. In certain instances, communications may take place between the surface of the well site and downhole elements. These communications may be referred to as downhole telemetry and may be used to transmit data from downhole sensors and equipment to computing systems located at the surface, which may utilize the data to inform further operations in numerous ways.

FIGURES

Some specific exemplary embodiments of the disclosure may be understood by referring, in part, to the following description and the accompanying drawings.

FIGS. 4A-E are diagrams illustrating another example fluidic pulser 400, according to aspects of the present disclosure.

Figure 5:
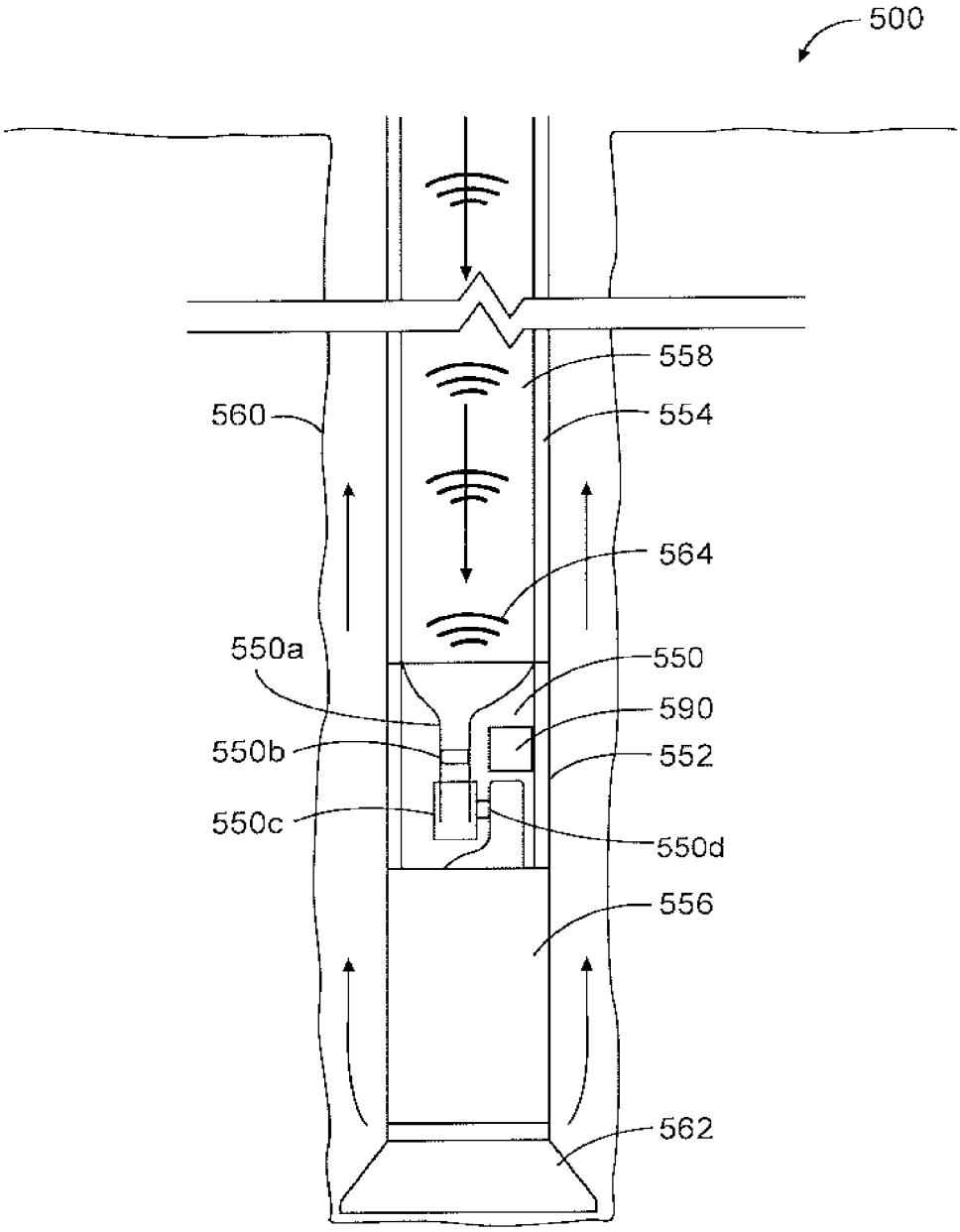

FIG. 5 is a diagram illustrating an example drilling system with a fluidic pulser that generates positive pressure pulses, according to aspects of the present disclosure.

Figure 6:
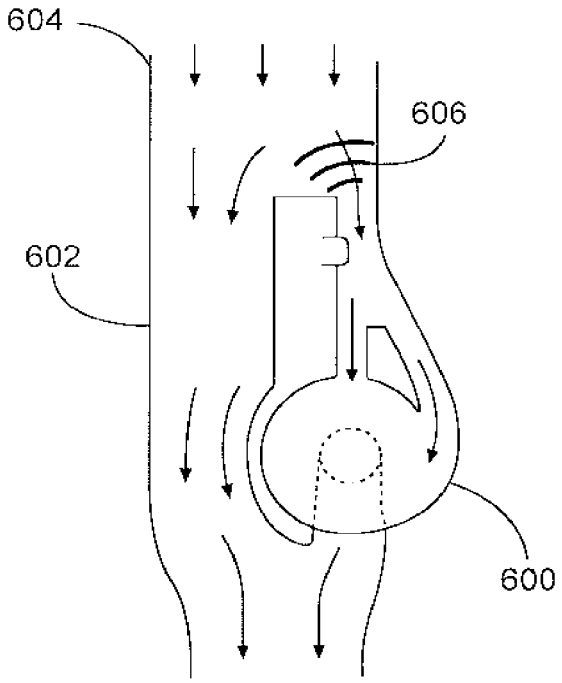

FIG. 6 is a diagram illustrating an example configuration for a fluidic pulser incorporating a by-pass channel, according to aspects of the present disclosure.

Figure 7:
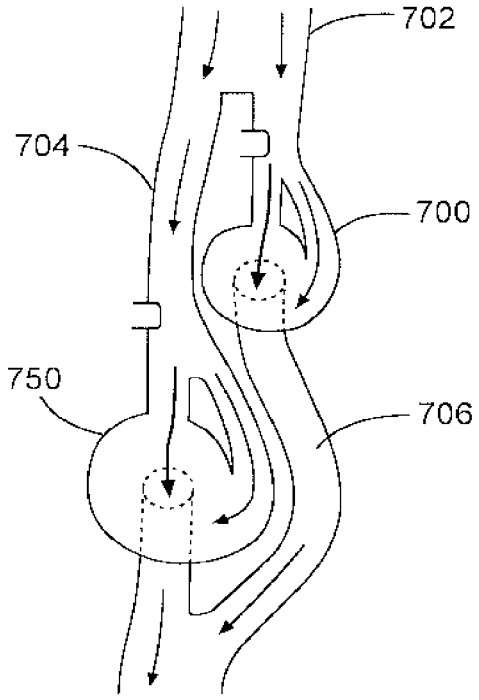

FIG. 7 is a diagram illustrating an example configuration for staggered fluidic pulsers, according to aspects of the present disclosure.

Figure 8:
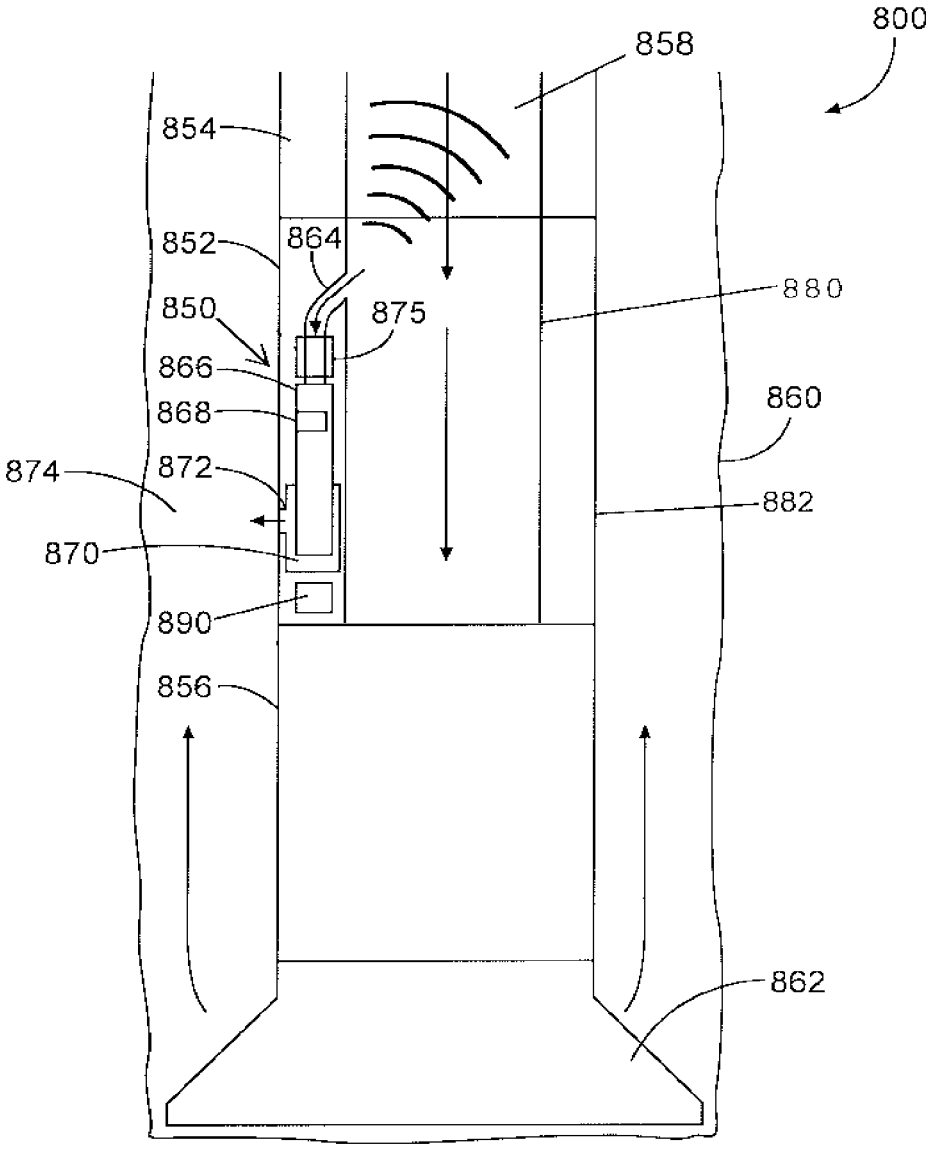

FIG. 8 is a diagram illustrating an example drilling system with a fluidic pulser that generates negative pressure pulses, according to aspects of the present disclosure.

Figure 9:
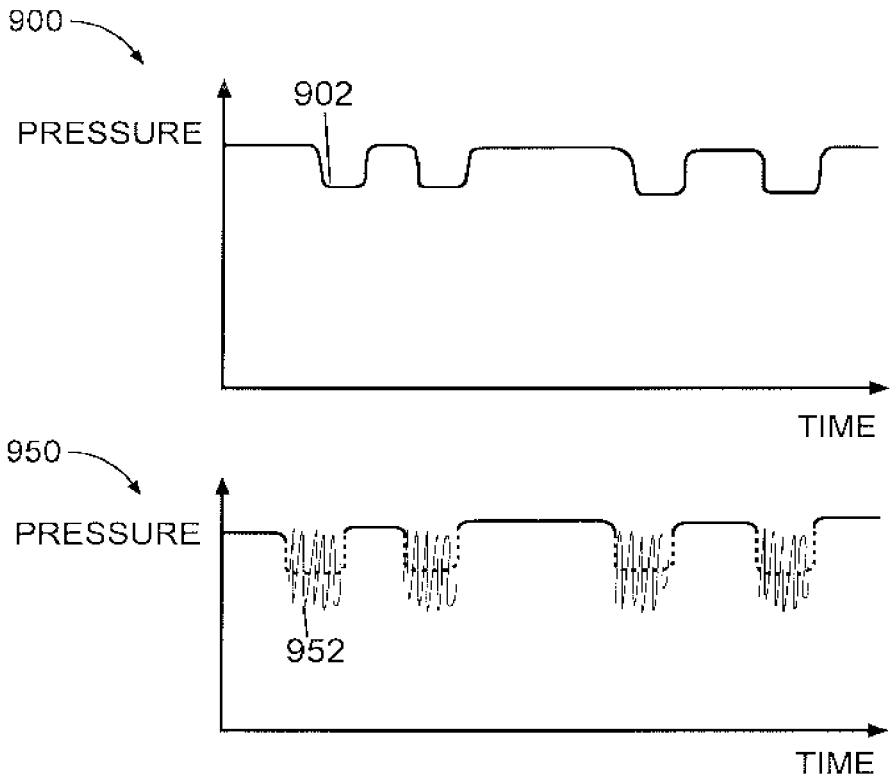

FIG. 9 includes graphs illustrating example negative pressure pulses with and without acoustic oscillation, according to aspects of the present disclosure.

Figure 10:
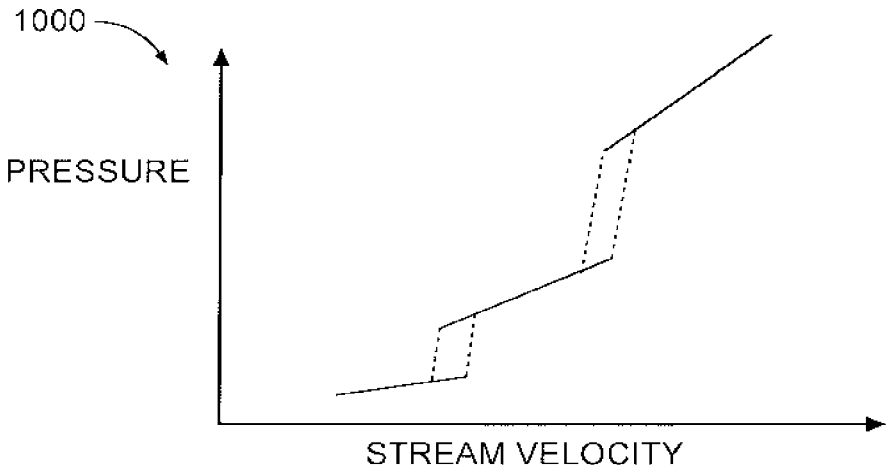

FIG. 10 is a graph that illustrates the oscillation frequencies of an edge-tone acoustic oscillator in terms of flow rate, according to aspects of the present disclosure.

Figure 11:
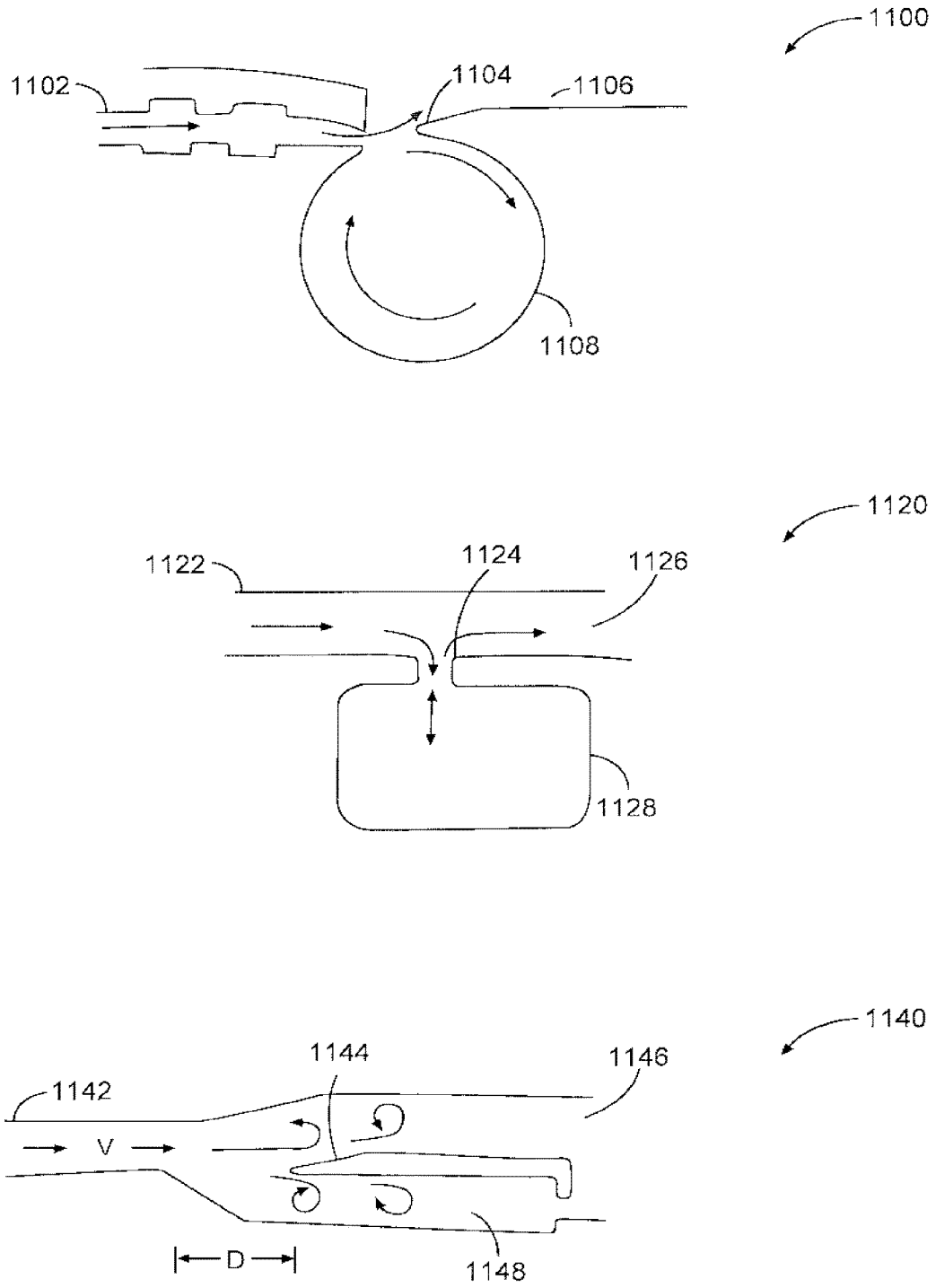

FIG. 11 is a diagram illustrating three types of whistle-type acoustic oscillator, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain embodiments may be used in one or more of wireline (including wireline, slickline, and coiled tubing), downhole robot, MWD, and LWD operations.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

Figure 1:
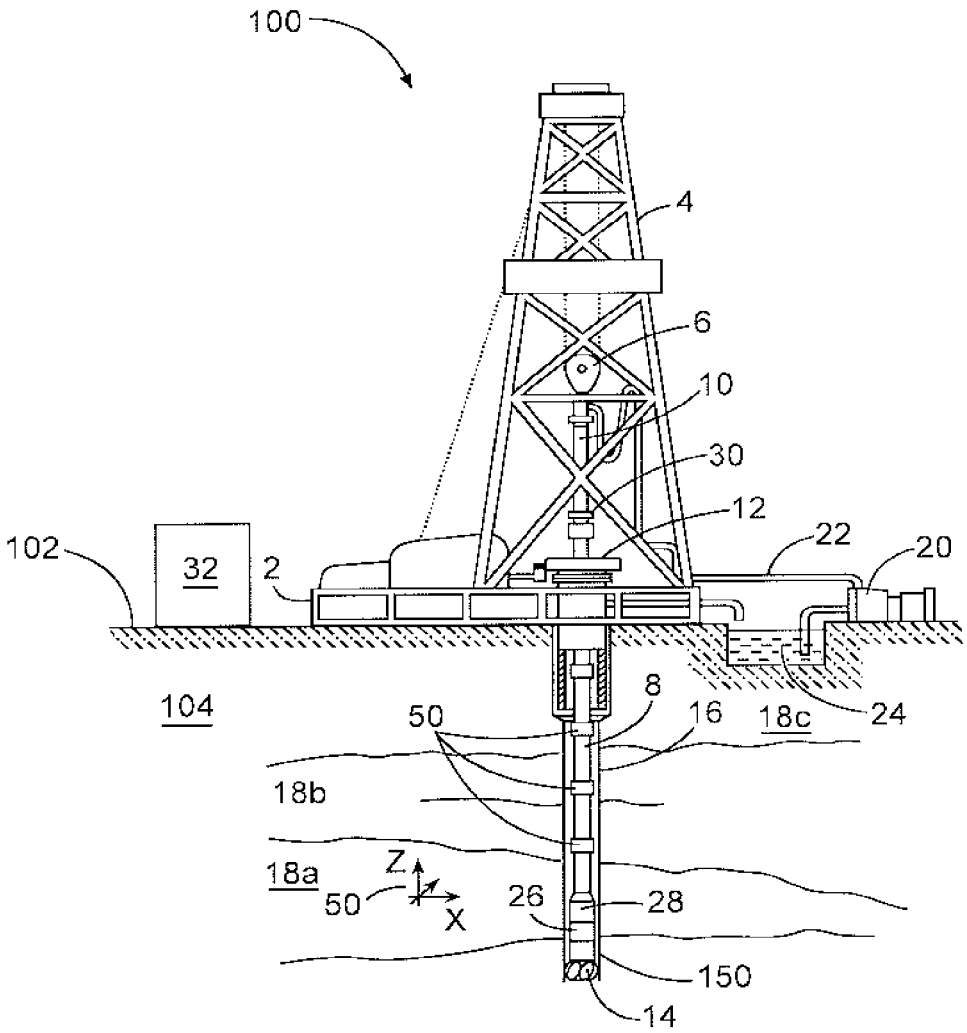
FIG. 1 is a diagram of an illustrative subterranean drilling system, according to aspects of the present disclosure.

FIG. 1 is a diagram of an illustrative subterranean drilling system 100, according to aspects of the present disclosure. The drilling system 100 comprises a drilling platform 2 positioned at the surface 102. In the embodiment shown, the surface 102 comprises the top of a formation 104 containing one or more rock strata or layers 18*a-c*, and the drilling platform 2 may be in contact with the surface 102. In other embodiments, such as in an off-shore drilling operation, the surface 102 may be separated from the drilling platform 2 by a volume of water.

The drilling system 100 comprises a derrick 4 supported by the drilling platform 2 and having a traveling block 6 for raising and lowering a drill string 8. A kelly 10 may support the drill string 8 as it is lowered through a rotary table 12. A drill bit 14 may be coupled to the drill string 8 and driven by a downhole motor and/or rotation of the drill string 8 by the rotary table 12. As bit 14 rotates, it creates a borehole 16 that passes through one or more rock strata or layers 18*a-c*. A pump 20 may circulate drilling fluid through a feed pipe 22 to kelly 10, downhole through the interior of drill string 8, through orifices in drill bit 14, back to the surface via the annulus around drill string 8, and into a retention pit 24. The drilling fluid transports cuttings from the borehole 16 into the pit 24 and aids in maintaining integrity of the borehole 16.

The drilling system 100 may comprise a bottom hole assembly (BHA) 150 coupled to the drill string 8 near the drill bit 14. The BHA may comprise various downhole measurement tools and sensors, including LWD/MWD elements 26. Example LWD/MWD elements 26 include antenna, sensors, magnetometers, gradiometers, etc. As the bit extends the borehole 16 through the formations 18, the LWD/MWD elements 26 may collect measurements relating to the formation and the drilling assembly.

In certain embodiments, the measurements taken by the LWD/MWD elements 26 and data from other downhole tools and elements may be transmitted to the surface 102 by a telemetry system. In the embodiment shown, the telemetry system comprises a fluidic pulser 28 located within the BHA and communicably coupled to the LWD/MWD elements 26. The fluidic pulser 28 may transmit the data and measurements from the downhole elements as pressure pulses in fluids injected into or circulated through the drilling assembly, such as drilling fluids, fracturing fluids, etc. As will be described below, the fluidic pulser may generate positive or negative pressure pulses within the fluid in the drill string. The pressure pulses may be generated in a particular patter, waveform, or other representation of data, an example of which may include a binary representation of data that is received and decoded at a surface receiver 30. The positive or negative pressure pulses may be received at the surface receiver 30 directly, or may be received and re-transmitted via signal repeaters 50. Such signal repeaters may, for example, be coupled to the drill string 8 at intervals, contain fluidic pulsers and receiver circuitry to receive and re-transmit corresponding pressure signals, and aide in the transmission of high frequency signals from the fluidic pulser 28, which would otherwise attenuate before reaching the surface receiver 30. In certain embodiments, as will be described below, acoustic oscillations may be incorporated into the pressure pulses to better define the transmitted telemetry signal. The drilling system 100 may further comprise an information handling system 32 positioned at the surface 102 that is communicably coupled to the surface receiver 30 to receive telemetry data from the LWD/MWD elements 26 and process the telemetry data to determine certain characteristics of the formation 104.

Figure 2A:
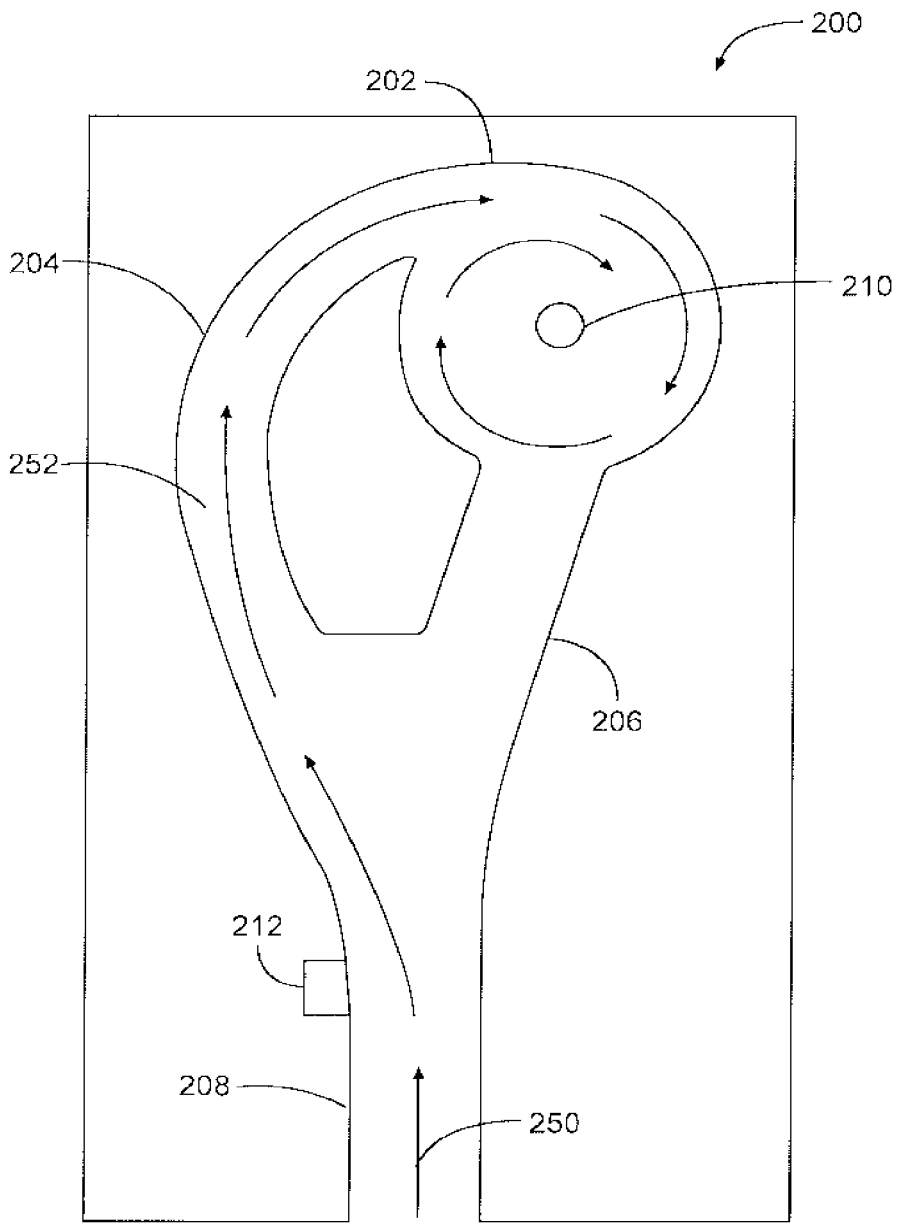
FIGS. 2A and 2B are diagrams that illustrate an example fluidic pulser, according to aspects of the present disclosure.
Figure 2B:
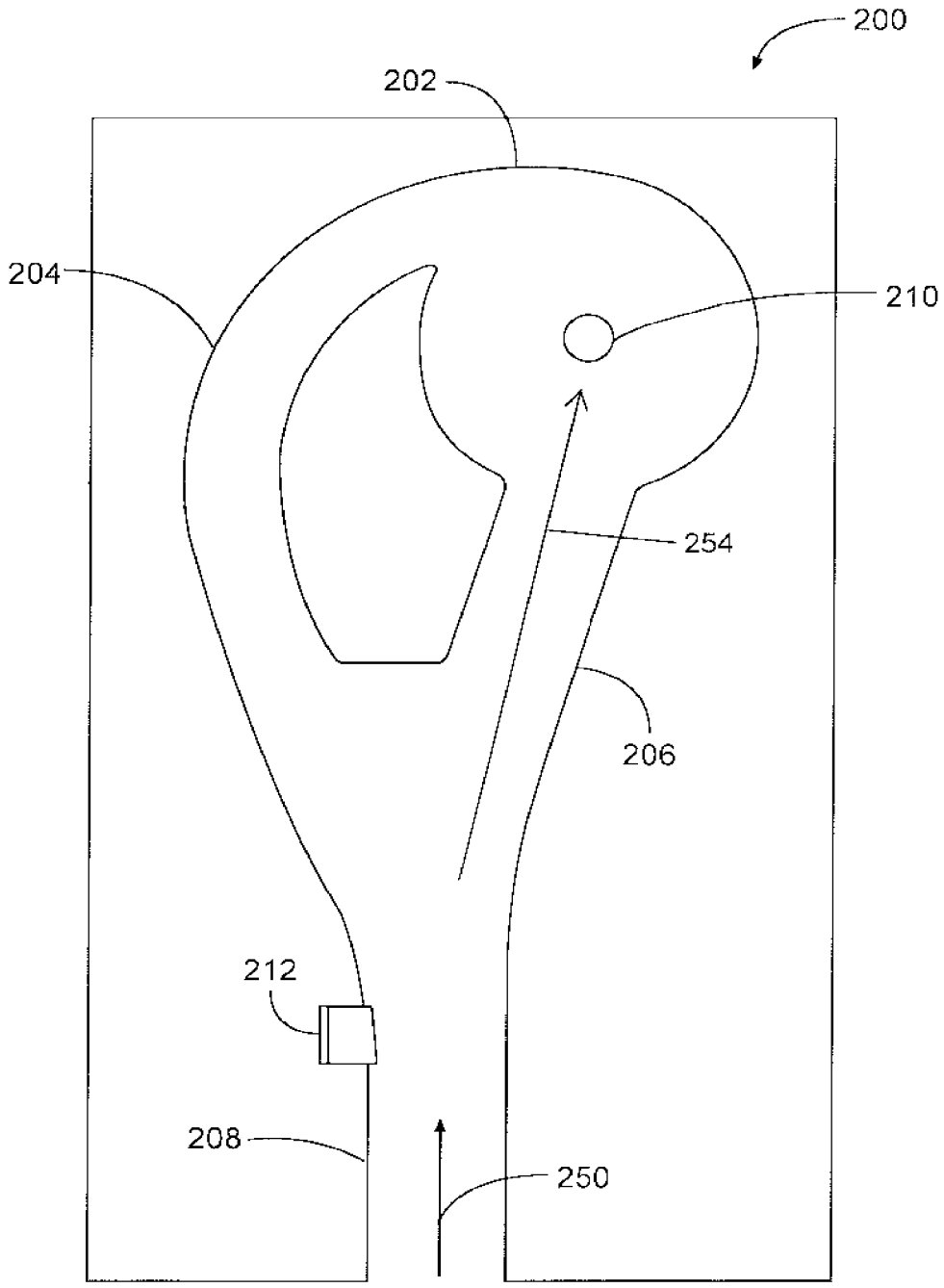

FIGS. 2A and 2B are diagrams of an example fluidic pulser 200, according to aspects of the present disclosure, which may be incorporated into a drilling system similar to the system described above. In the embodiment shown, the fluidic pulser 200 comprises a fluid inlet 208 that may provide fluid communication between a fluid source outside of the pulser 200 and a vortex basin 202 within the pulser 200 through at least one of a tangential fluid flow path 204 and a radial fluid flow path 206 between the vortex basin 202 and the fluid inlet 208. Specifically, fluid may enter the fluidic pulser 200 through the fluid inlet 208 which may be in fluid communication with a flow of fluid through a drilling system and further in fluid communication with both the tangential fluid flow path 204 and the radial fluid flow path 206. The vortex basin 202 may comprise a generally circular or cylindrical and hollow element that facilitates the formation of a fluid vortex. In certain embodiments, the vortex basin 202 may comprise a fluid outlet 210 located centrally within the vortex basin 202 through which fluid may exit the vortex basin 202 and the pulser 200.

The mud pulser 200 may further comprise a fluid flow path selector 212 configured to control the path through which fluid in the pulser 200 will flow. In the embodiment shown, the fluid flow path selector 212 comprises a control switch configured to selectively obstruct a portion of the fluid inlet 208 to thereby modify the cross-sectional flow area of the fluid inlet 208 proximate to the tangential fluid flow path 204 and the radial fluid flow path 206, to direct or encourage fluid to flow through a particular one of the tangential fluid flow path 204 and the radial fluid flow path 206, as will be described below. Example control switches comprise solenoids, locking solenoids, piezoceramics, voice coils, motors, magnetostrictors, ferroelectrics, relaxor ferroelectrics, pumps, bellows, and blowers. A power source (not shown) for the control switch, such as a battery pack, may be physically coupled to the fluidic pulser 200, or may be located remotely from the pulser 200 and electrically coupled to the control switch through one or more wires.

In operation, drilling fluid traveling through a drilling string in a drilling system (or other injected fluid in a drilling and completion system) may be wholly or partially diverted through the pulser 200, entering through the fluid inlet 208, as shown by arrow 250. As shown in FIG. 2A, when the control switch 212 is in a retracted position, the fluid may flow along one wall of the fluid inlet 208, based on the Coanda effect, and into the vortex basin 202 through the tangential fluid flow path 204, as shown by arrow 252. The Coanda effect describes the tendency of a fluid flow to be attracted to a nearby surface. Fluid entering the vortex basin 202 through the tangential fluid flow path 204 may form a vortex flowing in a clockwise direction. The fluid may spin in the vortex basin 202 until it exits through the fluid outlet 210, where it may continue to a downhole motor or through a drill bit, for example. In contrast, as shown in FIG. 2B, when the control switch 212 is in an extended position, it modifies the cross-sectional flow area of the fluid inlet 208, thereby instead directing the fluid flow through the radial fluid flow path 206, as shown by arrow 254, when it exits through the fluid outlet 210 without forming a vortex. Accordingly, a vortex may be selectively generated within the vortex basin 202 may actuating the control switch 212.

When selectively generating a vortex within the vortex basin 202 by selectively switching the flow of fluid between the tangential fluid flow path 204 and the radial fluid flow path 206, the fluid flow rate and pressure through the pulser 200 may change. Specifically, when switching the flow of fluid from the tangential fluid flow path 204 to the radial fluid flow path 206, the flow rate through the pulser 200 may increase, because any vortex in the vortex basin 202 is disrupted and fluid exits through the fluid outlet 210 directly, without forming a vortex. The increase in flow rate may correspond to a fluid pressure drop in the pulser 200, which may cause a corresponding low pressure pulse in the flow of fluid entering the pulser 200. Conversely, when switching the flow of fluid from the radial fluid flow path 206 to the tangential fluid flow path 204, the flow rate through the pulser 200 may decrease, due to the presence of the vortex, and the fluid pressure in the pulser 200 may increase, causing a corresponding high pressure pulse in the flow of fluid entering the pulser 200. Accordingly, positive/negative pressure pulses and increases/decreases in fluid flow may be created by switching between the fluid flow paths of the pulser 200, and the pressure and flow rate fluctuations may be received at the surface as a telemetry transmission.

Figure 3A:
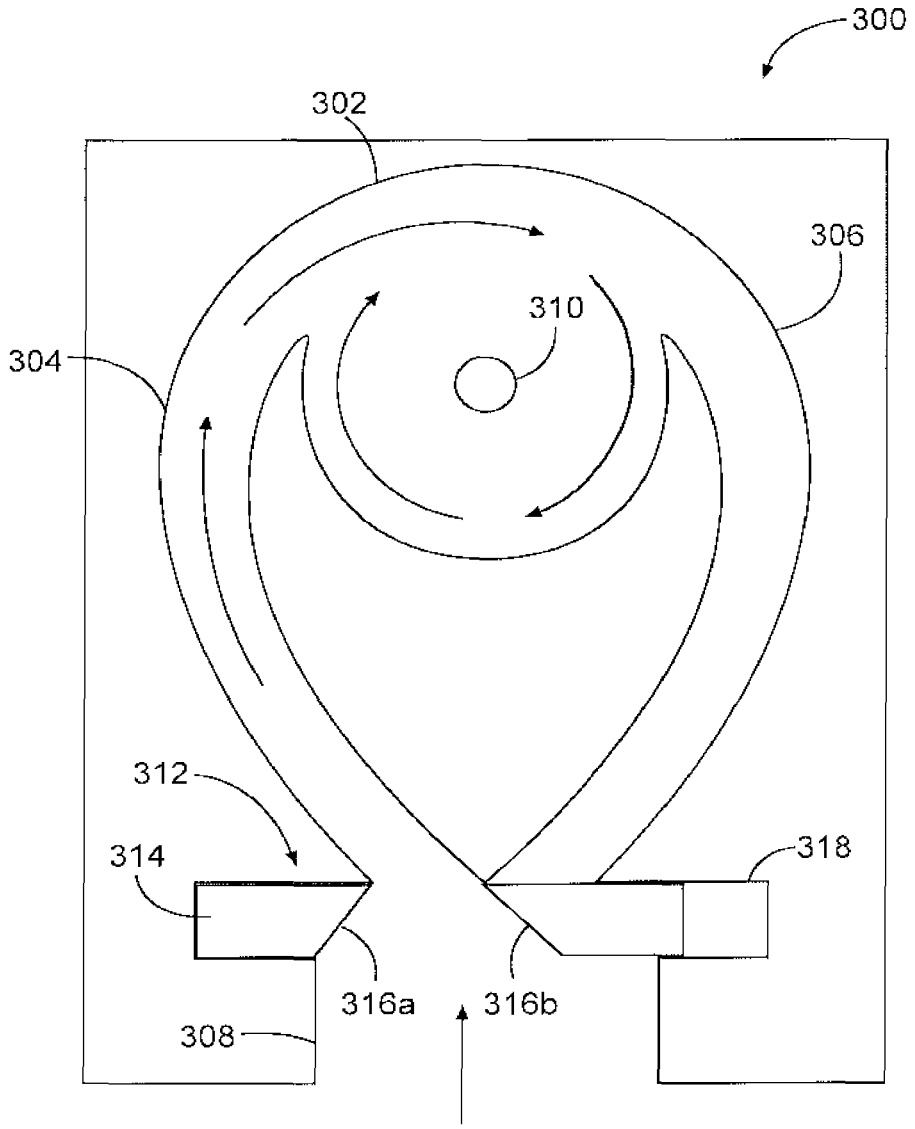
FIGS. 3A and 3B are diagrams illustrating another example fluidic pulser, according to aspects of the present disclosure.
Figure 3B:
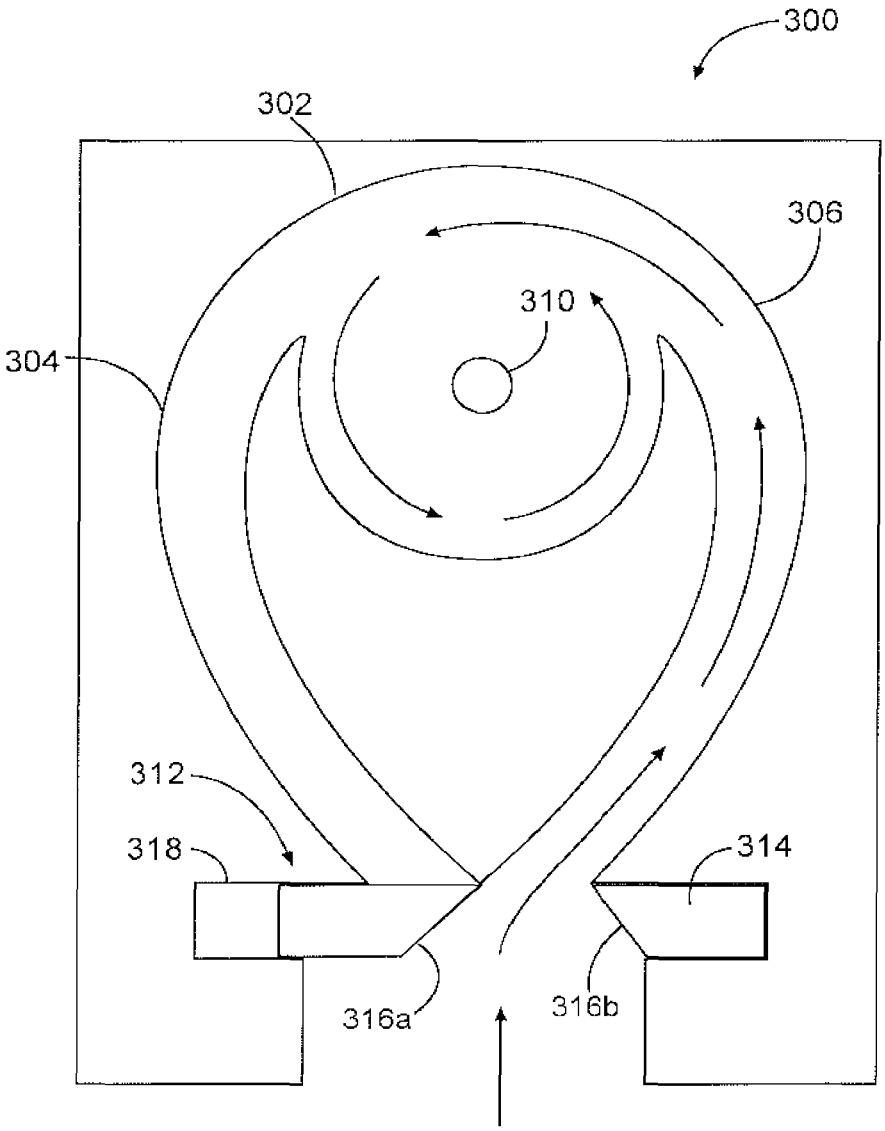

Other fluidic pulser configurations are possible, including pulsers with additional and differently oriented fluid flow pathways, and pulsers that utilize different types of fluid flow path selectors. FIGS. 3A and 3B are diagrams illustrating another example fluidic pulser 300, according to aspects of the present disclosure. The pulser 300 comprises a vortex basin 302, fluid inlet 308, and a fluid outlet 310 like the pulser in FIGS. 2A and 2B, but includes two tangential fluid flow paths rather and a tangential fluid flow path and a radial fluid flow path. Specifically, the pulser 300 comprises a first tangential fluid flow path 304 and a second tangential fluid flow path 306 between the fluid inlet 308 and the vortex basin 302. Fluid flow through the first tangential fluid flow path 304 may correspond to rotational fluid flow in the vortex basin 302 in a first, clockwise direction, as is shown in FIG. 3A, such that fluid flow through the tangential fluid flow path 304 may establish a clockwise vortex. And fluid flow through the second tangential fluid flow path 306 may correspond to rotational fluid flow in the vortex basin 302 in a second, counterclockwise direction, as shown in FIG. 3B, such that fluid flow through the tangential fluid flow path 306 may establish a counter-clockwise vortex.

The pulser 300 may further comprise fluid flow path selector 312, which may function to control the fluid paths 304 and 306 through which the fluid will flow. Unlike the pulser in FIGS. 2A and 2B, however, the fluid flow path selector 312 may control the fluid flow paths 304 and 306 through which the fluid will flow by selectively providing fluid communication between one of the fluid flow paths 304 and 306 and the fluid inlet 308 at a given time. In the embodiment shown, the fluid flow path selector 312 comprises a slider 314 with two angled faces 316*a* and 316*b* that is laterally movable between a first position and a second position in a widened portion 318 of the pulser 300 proximate the fluid inlet 308. When in the first position, as shown in FIG. 3A, the slider 314 blocks the second tangential fluid flow path 306 and allows full fluid communication between the fluid inlet 308 and the first tangential fluid flow path 304. In contrast, when in the second position, as shown in FIG. 3B, the slider 314 blocks the first tangential fluid flow path 304 and allows full fluid communication between the fluid inlet 308 and the second tangential fluid flow path 306. The slider 314 may also be positioned at intermediate positions between the first and second positions, in which partial fluid communication is provided to both the first tangential fluid flow path 304 and the second tangential fluid flow path 306. Notably, other types of fluid flow path selectors may be used with the pulser configuration shown in FIGS. 3A and 3B, including, but not limited to, a slider, controlled by a motor, that is rotatably movable between a first and second position with respect to first and second fluid flow paths to selectively block fluid from entering one fluid flow path.

When fluid flow is switched between the first tangential fluid flow path 304 and the second tangential fluid flow path 306, and vice versa, the existing vortex is disrupted and there is a delay before a new vortex can be generated in the opposite direction. During those delays, the pulser 300 shows flow rate and pressure characteristics similar to those described above with respect to the radial fluid flow path in FIGS. 2A and 2B, i.e., higher flow rate and lower pressure than when a vortex is formed, but with a shorter, temporary duration. Accordingly, low pressure pulses are generated both when switching the fluid flow path from the first tangential fluid flow path 304 to the second tangential fluid flow path 306 and when switching the fluid flow path from the second tangential fluid flow path 306 to the first tangential fluid flow path 308. This increases the frequency with which low pressure pulses can be generated when compared to the pulser in FIGS. 2A and 2B, because a low pressure pulse is generated every time the fluid flow path selector 312 moves, rather than only when the fluid flow path selector directs fluid through a radial fluid flow path.

The frequency with which pressure pulses can be generated affects the bandwidth of data that can be transmitted to the surface from the fluidic pulser. Specifically, the higher the frequency, the more data can be transmitted in a given duration of time. In certain embodiments, the number of fluid flow pathways may be increased to increase the pressure pulse frequency generated by the fluidic pulser. FIGS.

4A-E are diagrams illustrating another example fluidic pulser 400, according to aspects of the present disclosure. Like the pulsers discussed previously, the pulser 400 comprises a vortex basin 402, a fluid inlet 408, and a fluid outlet 410. Unlike the pulsers described earlier, however, the pulser 400 comprises four fluid flow paths between the inlet 408 and vortex basin 402 rather than two: first tangential fluid flow path 450, second tangential fluid flow path 452, third tangential fluid flow path 454, and fourth tangential fluid flow path 456. Two of the fluid flow paths, first tangential fluid flow path 450 and third tangential fluid flow path 454, may correspond to rotational fluid flow and establish vortex circulation in a first direction, and two of the fluid flow paths, second tangential fluid flow path 452 and fourth tangential fluid flow path 456, may correspond to rotational fluid flow and establish vortex circulation in a second direction. In the embodiment shown, the fluid flow paths 450-456 are coupled to the vortex basin 402 at different axial and angular orientations, and are coupled to the fluid inlet 408 at different heights and lateral positions. This configuration accommodates the increased number of fluid flow paths, but is not meant to be limiting, nor is the number of fluid flow pathways shown.

Figure 4A:
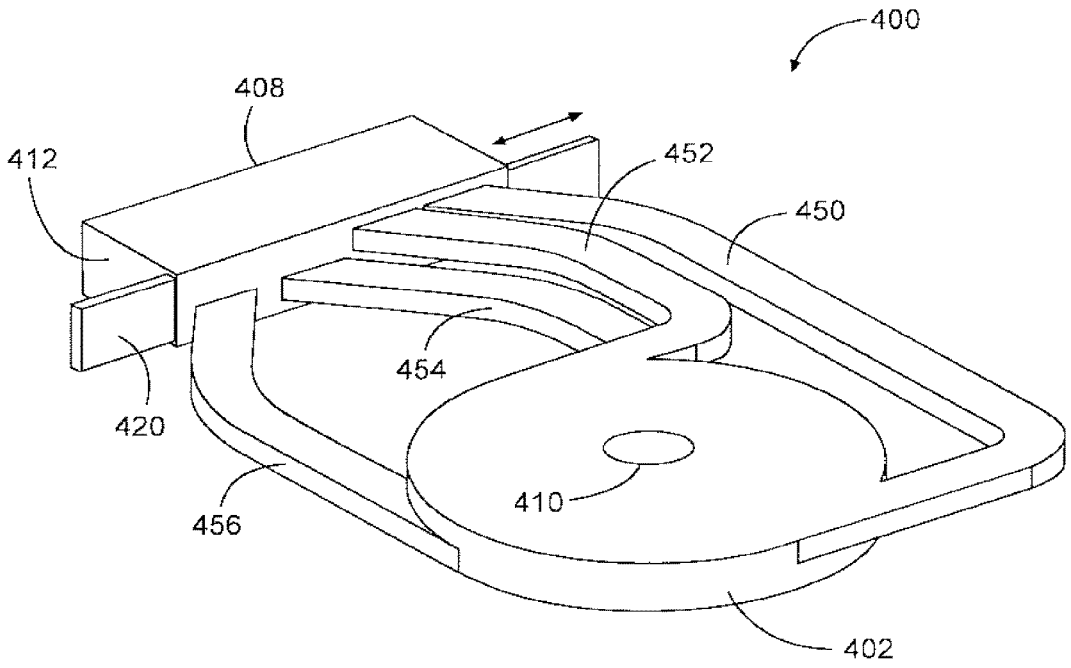
Figure 4B:
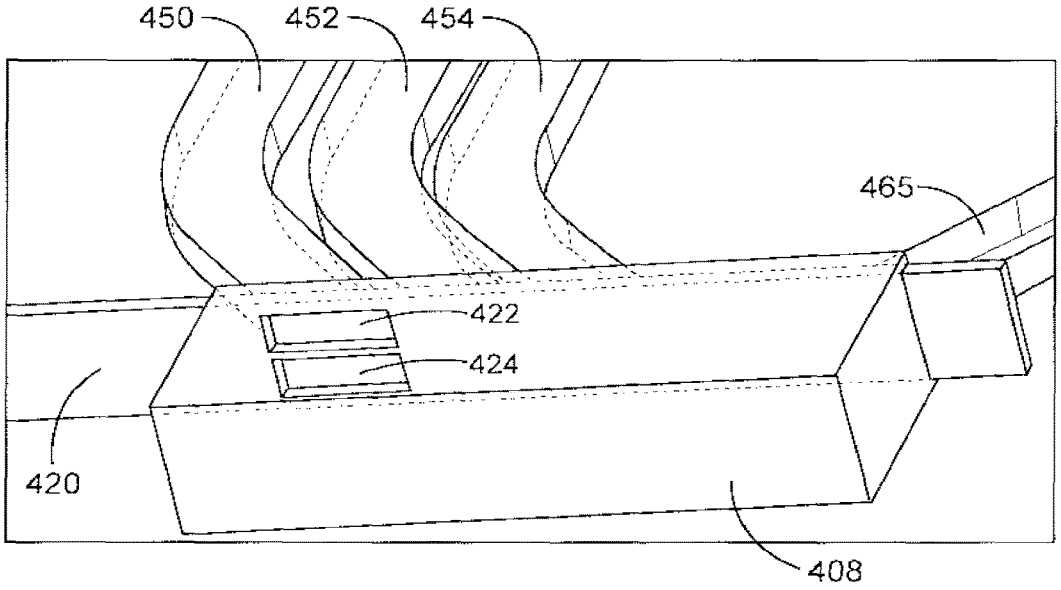
Figure 4C:
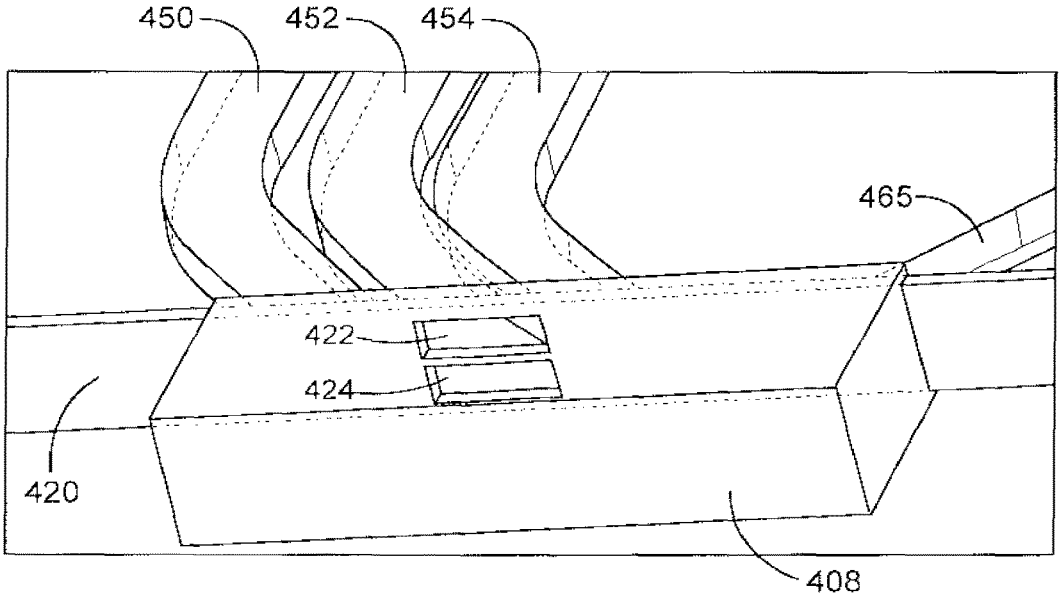
Figure 4D:
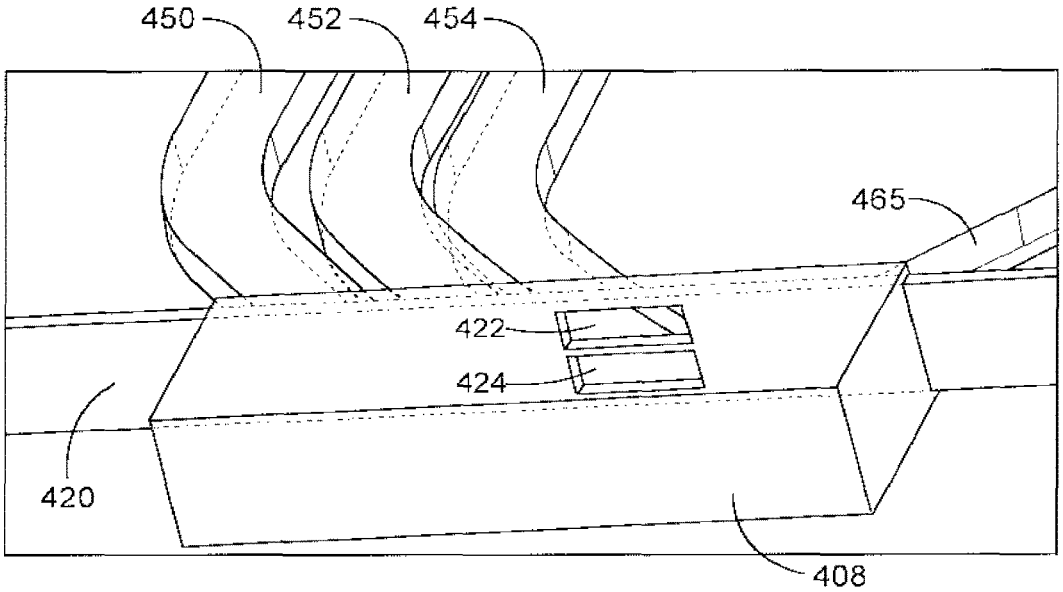
Figure 4E:
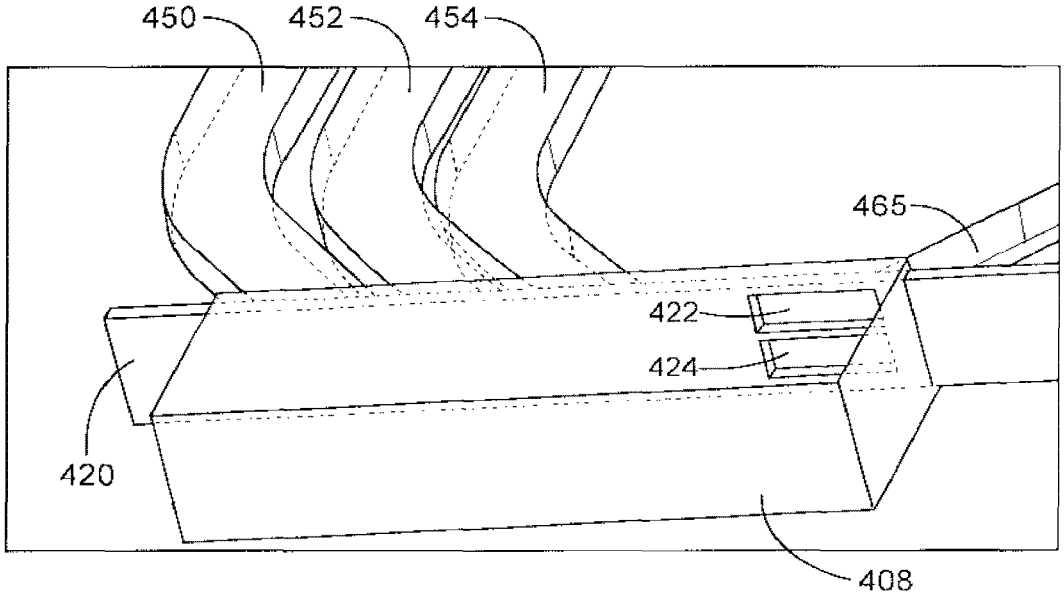

The pulser 400 further comprises a fluid flow path selector 412 at an interface between the fluid inlet 408 and the fluid flow paths 450-456. In the embodiment shown, the fluid flow path selector 412 comprises a slider 420 that protrudes from and is laterally movable with respect to the fluid inlet 408. The slider 420 comprises openings 422 and 424 through which fluid communication can be established between the fluid inlet 408 and one of the fluid flow paths 450-456 at a time. As can be seen in FIGS. 4B-4E, the slider 420 may be movable into set positions corresponding to the fluid flow paths 450-456. FIG. 4B, for instance, shows the slider 420 in a first position corresponding to first tangential fluid flow path 450, in which fluid flow paths 452-456 are blocked and fluid communication is provided between the fluid inlet 408 and the first tangential fluid flow path 450 through the opening 422. FIG. 4C shows the slider 420 in a second position corresponding to second tangential fluid flow path 452, in which fluid flow paths 450, 454, and 456 are blocked and fluid communication is provided between the fluid inlet 408 and the second tangential fluid flow path 452 through the opening 422. FIG. 4D shows the slider 420 in a third position corresponding to third tangential fluid flow path 454, in which fluid flow paths 450, 452, and 456 are blocked and fluid communication is provided between the fluid inlet 408 and the third tangential fluid flow path 454 through the opening 424. FIG. 4E shows the slider 420 in a fourth position corresponding to fourth tangential fluid flow path 456, in which fluid flow paths 450-454 are blocked and fluid communication is provided between the fluid inlet 408 and the fourth tangential fluid flow path 456 through the opening 424.

The slider 420 may move sequentially from the first through fourth positions, then in backwards sequence from the fourth through first positions, with each movement corresponding to a disruption to a vortex in the vortex basin 402. Notably, the fluid flow paths 450-456 are arranged such that when they are sequentially opened by the slider 420, the next fluid flow path to be opened by the slider 420 causes a vortex in the opposite direction of the vortex caused by the current fluid flow path. This ensures that the vortex is sufficiently disrupted to generate a low pressure pulse. Other arrangements of fluid flow path selectors and fluid flow paths may accomplish this function, including but not limited to a rotating selector and a cam-shaft with spring loaded valves to act as doors to the fluid flow paths.

As mentioned previously, fluidic pulsers incorporating aspects of the present disclosure may generate fluid telemetry signals, e.g., positive or negative pressure pulses, to transmit data to the surface. FIG. 5 is a diagram illustrating an example drilling system 500 with a fluidic pulser 550 that generates pressure pulses, according to aspects of the present disclosure. The fluidic pulser 550 may comprise any of the fluidic pulsers described thus far or any other fluidic pulser incorporating aspects of the present disclosure. In the embodiment shown, the pulser 550 is incorporated into a drill collar 552 that is coupled to a drill string 554 and a power/electronics section 556, which may comprise LWD/MWD elements. A similar collar 552 may be attached further up the drill string 554, for example, when the pulser 550 is to function as a signal repeater. The drill string 554 may comprise an internal bore 558 through which fluid is injected or circulated into the borehole 560. The pulser 550 may be located within the bore 558 such that all of the fluid traveling through the drill string 554 enters the pulser 550 at a fluid inlet 550*a*. Once in the pulser 550, fluid may travel through a fluid flow path selector 550*b* into a vortex basin 550*c*, before exiting a fluid outlet 550*d*, where the fluid can continue flowing to and out of a drill bit 562. Pressure pulses 564 may be generated in the bore 558 by the pulser 550, as described above, where they can be received and decoded at the surface. Control circuitry 590 located in the collar 552 may be communicably coupled to the fluid flow path selector 550*b* and a power source (not shown) to generate the pulses, and may also include pressure sensing circuitry when the collar 552 and pulser 550 are used as a signal repeater. The control circuitry 590 may comprise an information handling system with a processor and a memory device, such as a microcontroller.

The presence of the pulser 550 within the bore 558 may function to restrict the fluid flow through the drill string 554 no matter the fluid flow path selected in the pulser 550. When high fluid flow rates are required for the downhole operation, staggered pulsers and/or by-pass channels may be incorporated to allow some of the fluid to travel from the drill string 554 to the drill bit 562 without entering the pulser 550. FIG. 6 is a diagram illustrating an example configuration for a fluidic pulser 600 incorporating a by-pass channel 602, according to aspects of the present disclosure. As can be seen, both the pulser 600 and the by-pass channel 602 are in fluid communication with a primary flow channel 604, such as the internal bore of a drill string. A portion of the fluid traveling through the primary flow channel 604 may enter the pulser 600, while the remainder travels through the by-pass channel 602. The pulser 600 may generate pressure pulses 606 in the flowing fluid, but the overall flow restriction caused by the pulser 600 may be reduced by the generally free-flowing fluid through the by-pass channel 602.

FIG. 7 is a diagram illustrating an example configuration for staggered fluidic pulsers 700 and 750, according to aspects of the present disclosure. Both the pulser 700 and the pulser 750 are in fluid communication with a primary flow channel 702, but the pulsers 700 and 750 are oriented differently with respect to the flow channel so that part of the fluid is allowed to by-pass a pulser at each step. In particular, fluid flowing through the primary flow channel 702 may be split between pulser 700 and a first by-pass channel 704. Fluid traveling through the first by-pass channel 704 may enter pulser 750 whereas fluid traveling through pulser 700 may exit into a second by-pass channel 706. Accordingly, at each step fluid is allowed to travel freely through a by-pass channel, rather than being restricted by a pulser.

FIG. 8 is a diagram illustrating another example drilling system 800 with a fluidic pulser 850 that generates pressure pulses, according to aspects of the present disclosure. The fluidic pulser 850 may comprise any of the fluidic pulsers described thus far or any other fluidic pulser incorporating aspects of the present disclosure. Like the systems described above, the system 800 comprises a drill collar 852 coupled to a drill string 854 and a power/electronics section 856, which may comprise LWD/MWD elements, the drill collar 852 also being capable of coupling to the drill string 854 at a different location for the pulser 850 to act as a signal repeater. Also like the systems described above, the drill string 854 may comprise an internal bore 858 through which fluid is injected or circulated into the borehole 860.

Unlike the above systems, however, the pulser 850 may be located within the collar 852 but outside of the bore 858, such that drilling fluid traveling within the bore 858 of the drill string 854 is not restricted by the drill collar 852 on its way to the drill bit 862. In the embodiment shown, the pulser 850 is located within an outer structure of the collar 852, characterized by an inner diameter 880 and an outer diameter 882. The outer structure may comprise, for example, a generally cylindrical metal tube or pipe which may threadedly couple to both the drill string 854 and the power/electronics section 856. As can be seen, the inner diameter 880 may be substantially the same as the diameter of the bore 858, preserving a "full bore" fluid flow to the drill bit 862.

The collar 852 may comprise a fluid channel through its side that provides fluid communication between the bore 858 and the annulus 874. The pulser 850 and its components, such as vortex basin 870, fluid inlet 866, fluid flow path selector 868, and fluid outlet 872, may at least partially define the fluid channel, and may facilitate fluid communication between the bore 858 and the annulus 874. Although the pulser 850 is shown within the outer structure of the collar 852, the pulser may also be located within the bore 858 and at least partially define a fluid channel between the annulus 874 and the bore 858 through the side of the collar 852.

In the embodiment shown, as fluid flows through the bore 858, a portion may be diverted into the fluid channel through port 864 in the collar 852, which may be coupled to the fluid inlet 866 of the pulser 850. Once inside the pulser 850, the fluid may flow past fluid flow path selector 868, into vortex basin 870, and out of fluid outlet 872 into the annulus 874. Drilling fluid may flow through and out of the drill bit 862 to return to the surface, and the drilling fluid diverted through the pulser 850 may exit to the return flow through the fluid outlet 872. This fluid flow may cause a pressure drop within the bore 858, with the extent of the pressure drop depending on the fluid flow rate through the pulser 850.

The flow rate through the fluid channel in the collar 852 may control a pressure drop within the bore 858, with higher flow rates corresponding to larger pressure drops. As is described above, the presence of a vortex within the vortex basin 870 of the pulser 850 may decrease the flow rate through the pulser 850. Accordingly, a fluid telemetry signal, such as a pressure pulse, may be generated at the collar 852 by selectively generating a vortex within the fluid channel, and the vortex basin 870 in particular. The pulses may be created using control circuitry 890, which may be communicably coupled to and otherwise control the fluid flow path selector 868, and also include pressure sensing capability when the pulser 850 is used as a signal repeater.

In the embodiment shown, system 800 comprises an acoustic oscillator 875 in fluid communication with and responsive to a change in fluid flow rate through the vortex basin 870. In particular, the oscillator is in fluid communication with the flow of drilling fluid in the bore 858 via the port 864 and also in fluid communication with the fluid inlet 866 of the pulser 850. As fluid flows into the pulser 850 through the port 864, it may flow through the acoustic oscillator 875, which may create a carrier frequency that is modulated by the pulser 850. In particular, the frequency and/or amplitude with which the oscillator 850 oscillates may be based, at least in part, on the fluid flow rate through the oscillator 875, which may be altered by the fluid flow path selector 868 of the pulser 850, as described above.

FIG. 9 includes graphs 900 and 950 illustrating example negative pressure pulses with and without acoustic oscillation, respectively, according to aspects of the present disclosure. In particular, graphs 900 and 950 plot negative pressure pulses or portions generated with an example fluidic pulser in a configuration similar to the one described with respect to FIG. 8. As can be seen, the negative pressure pulses in graph 900, such as pulse 902, are defined drops in pressure that may propagate through the fluid in the bore of a drill string to a surface receiver. These pressure drops may be identified by the surface receiver, which may record and process the corresponding telemetry signal from the pulses. In high noise environments, or environments where unwanted pressure fluctuations are possible, the use of an acoustic oscillator may increase the detection of the pulses through the use of a carrier frequency, which may be detected by the surface receiver in addition to the pressure pulses. The pressure pulse 952 in graph 950 illustrates the carrier frequency modulation.

The oscillation amplitude and frequency may be set by the configuration of the acoustic oscillator, as will be described below, and may be caused by the increase in flow rate corresponding to a pressure drop in a pulser. In certain embodiments, the frequency may be selected to avoid the frequency band of acoustic noise typically encountered in a downhole environment. Additionally, acoustic filters, such as narrow-band filters, may be selected and implemented at a surface receiver to filter out acoustic signals outside of the oscillator frequency, increasing the likelihood of detection of the pressure pulse. In yet other embodiments, multiple fluidic pulsers may be used, each with an acoustic oscillator tuned to a different frequency, and a surface receiver may be used with an acoustic filter corresponding to each oscillation frequency of the oscillators. The use of multiple frequencies may increase the communication channels to the surface receiver and therefore the bandwidth with which data can be communicated to the surface.

In certain embodiments, the acoustic oscillator may be configured to operate at different frequencies based, at least in part, on a fluid flow rate through the oscillator. FIG. 10 is a graph 1000 illustrates the oscillation frequencies of an edge-tone acoustic oscillator in terms of flow rate. Example edge-tone oscillators are described below. As can be seen, significantly different flow velocities through the oscillator may cause the oscillation frequency to change. In certain embodiments, the different frequencies may comprise harmonic frequencies, and the oscillation frequency may jump to different harmonics when the flow rate changes, manifesting as frequency-shift keying in the oscillator output.

Although the acoustic oscillator is described above with respect to a negative pressure pulse configuration, an acoustic oscillator may be used to generate a carrier signal in any of the configurations described herein, including use with any of the fluidic pulsers described above. Similarly, different types of acoustic oscillators may be used in each of the configurations and with each of the fluidic pulsers, with example types of acoustic oscillators including, but not limited to, whistle-type oscillators, sirens, and fluidic oscillators. FIG. 11 is a diagram illustrating three types of whistle-type acoustic oscillator, according to aspects of the present disclosure. The whistle-type acoustic oscillators are characterized by resonance chambers in which a flow of fluid past or through the resonance chamber causes an oscillation with a frequency based, at least in part, on the physical parameters of the resonance chamber. Oscillator 1100 comprises a pea-less whistle in which fluid enters a fluid inlet 1102 and oscillates on either side of labium 1104 as it exits through an outlet 1006, with the oscillation frequency affected and set by fluid flow within resonance chamber 1108. Oscillator 1120 comprises a Helmholtz resonator in which fluid enters an inlet 1122, flows past an opening 1124 to a resonance chamber 1128 and through an outlet 1126, with the flow past the opening 1124 causing the fluid within the chamber 1128 and in the opening 1124 to compress and expand at a frequency of oscillation. Oscillator 1140 comprises an edge-tone oscillator, in which the frequency of oscillation change based on a flow rate. In the embodiment shown, fluid flows into the oscillator at an inlet 1142 at a flow rate V and travels a distance D to a labium 1144, where the flow oscillates between a resonance chamber 1148 and an outlet 1146. The first frequency f generated by the oscillator 1140 may be characterized by the equation $f \approx (0.2*V)/D$.

In addition to the whistle-type oscillators described above, other oscillator types like sirens and fluid oscillators may be used. A siren, for example, may comprise a device with a fixed disk and a rotating disk that periodically occludes fluid flow. The rotating disk and fixed disk may both include passageways, which may be periodically aligned based on the position of the rotating disk. Other sirens may include the used of a rotating cylinder or a Darrieus-style rotor that periodically occludes the flow stream. In other embodiments, fluid oscillators may be used to create acoustic pressure pulses.

According to aspects of the present disclosure, an example method for downhole telemetry includes providing fluid communication between an internal bore of a drill string and an annulus between the drill string and a borehole through a fluid channel in a side of a collar coupled to the drill string. Fluid may be circulated through the internal bore of the drill string. The method may further include generating a fluid telemetry signal by selectively generating a vortex within the fluid channel. In certain embodiments, wherein providing fluid communication between the internal bore and the annulus through the fluid channel may include providing fluid communication between the internal bore and a vortex basin at least partially defining the fluid channel, through at least one of a first fluid flow path and a second fluid flow path between the vortex basin and the internal bore; and providing fluid communication between the vortex basin and the annulus through a fluid outlet of the vortex basin.

In certain embodiments, the first fluid flow path may comprise a radial fluid flow path and the second fluid flow path may comprise a tangential fluid flow path. In those embodiments, generating the vortex within the fluid channel may comprise generating the vortex within the vortex basin by changing a fluid flow from the radial fluid flow path to the tangential fluid flow path. And changing the fluid flow from the radial fluid flow path to the tangential fluid flow path may comprise modifying a cross-sectional flow area of a fluid inlet coupled the tangential fluid flow path and the radial fluid flow path.

In certain embodiments, selectively generating a vortex within the fluid channel may comprise generating the vortex within the vortex basin rotating in an opposite direction than a previous vortex within the vortex basin. In certain embodiments, the first fluid flow path may comprises a first tangential fluid flow path and the second fluid flow path may comprise a second tangential fluid flow path. In those embodiments, generating the vortex within the vortex basin rotating in an opposite direction than the previous vortex within the vortex basin may comprise changing a fluid flow from the first tangential fluid flow path to the second tangential fluid flow path, or changing the fluid flow from the second tangential fluid flow path to the first tangential fluid flow path. Changing the fluid flow from the first tangential fluid flow path to the second tangential fluid flow path may comprise blocking fluid communication between the internal bore and the first tangential flow path; and changing the fluid flow from the second tangential fluid flow path to the first tangential fluid flow path may comprise blocking fluid communication between the internal and the second tangential flow path.

In certain embodiments, the method may further include receiving the fluid telemetry signal from the collar at a signal repeater coupled to the drill string above the collar and generating a corresponding fluid telemetry signal in the circulating fluid using the signal repeater. Generating the corresponding negative pressure pulse may comprise providing fluid communication between the internal bore of the drill string and the annulus through a second collar and altering a rate of fluid flow through the second collar.

According to aspects of the present disclosure, an example apparatus for downhole telemetry comprises a fluid inlet and a vortex basin with a fluid outlet. A first fluid flow path may be between the fluid inlet and the vortex basin, and the first fluid flow path may correspond to rotational fluid flow in the vortex basin in a first direction. A second fluid flow path may be between the fluid inlet and the vortex basin, and the second fluid flow path may correspond to rotational fluid flow in the vortex basin in a second direction, opposite the first rotational direction. A fluid flow path selector may be movable to provide selective fluid communication between the fluid inlet and the vortex basin through one of the first fluid flow path and the second fluid flow path.

In certain embodiments, the first fluid flow path and the second fluid flow path may comprise tangential fluid flow paths. In certain embodiments the fluid flow path selector may comprise one of a first slider with two angled faces laterally movable between a first position and a second position with respect to the first fluid flow path and the second fluid flow path; and a second slider rotatably movable between a first position and a second position with respect to the first fluid flow path and the second fluid flow path. In certain embodiments, the apparatus may further comprise a third fluid flow path between the fluid inlet and the vortex basin, with the third fluid flow path corresponding to rotational fluid flow in the vortex basin in the first direction; and a fourth fluid flow path between the fluid inlet and the vortex basin, with the fourth fluid flow path corresponding to rotational fluid flow in the vortex basin in the second direction. The fluid flow path selector may be movable to provide selective fluid communication between the fluid inlet and the vortex basin through one of the first, second, third, and fourth fluid flow paths. In certain embodiments, the fluid flow path selector may comprise one of a slider sequentially movable between first, second, third, and fourth positions corresponding respectively to the first, second, third and fourth fluid flow paths; and a rotating selector comprising first, second, third, and fourth spring-loaded valves corresponding respectively to the first, second, third and fourth fluid flow paths.

An example system for downhole telemetry may comprise a drill string with an internal bore and a fluidic pulser in fluid communication with the internal bore. An acoustic oscillator may be in fluid communication with the fluidic pulser. The acoustic oscillator may alter at least one of an oscillation frequency and an oscillation amplitude in response to a change in fluid flow rate through the fluidic pulser. The system may further comprise a surface receiver in fluid communication with the internal bore and that includes an acoustic filter corresponding to the oscillation frequency. The acoustic oscillator may comprise at least one of a pea-less whistle, a Helmholtz resonator, an edge-tone oscillator, a siren, or a fluidic oscillator.

In certain embodiments, a by-pass channel may be in fluid communication with the internal bore and arranged parallel with the fluidic pulser. The system may further comprise a second fluidic pulser in fluid communication with the internal bore and a second acoustic oscillator, the second acoustic oscillator characterized by a second oscillation frequency different from the oscillation frequency of the acoustic oscillator. The system may further comprise a surface receiver in fluid communication with the internal bore and that includes a first acoustic filter corresponding to the oscillation frequency of the acoustic oscillator, and a second acoustic filter corresponding to the second oscillation frequency of the second acoustic oscillator.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A system for downhole telemetry, comprising:

a drill string with an internal bore;

a fluidic pulser in fluid communication with the internal bore; and an acoustic oscillator in fluid communication with the fluidic pulser.

2. The system of claim 1, wherein the acoustic oscillator alters at least one of an oscillation frequency and an oscillation amplitude in response to a change in fluid flow rate through the fluidic pulser.

3. The system of claim 2, further comprising a surface receiver in fluid communication with the internal bore and including an acoustic filter corresponding to the oscillation frequency.

4. The system of claim 3, wherein the acoustic filter is a narrow-band filter.

5. The system of claim 3, wherein the acoustic filter filters out acoustic signals outside of the oscillation frequency.

6. The system of claim 1, wherein the acoustic oscillator comprises at least one of a pea-less whistle, a Helmholtz resonator, an edge-tone oscillator, a siren, and a fluidic oscillator.

7. The system of claim 1, wherein the acoustic oscillator comprises a device with a fixed disk and a rotating disk that periodically occludes fluid flow.

8. The system of claim 1, further comprising a by-pass channel in fluid communication with the internal bore and arranged parallel with the fluidic pulser.

9. The system of claim 1, wherein the acoustic oscillator is characterized by a first oscillation frequency.

10. The system of claim 9, wherein the first oscillation frequency is selected to avoid the frequency band of acoustic noise typically encountered in a downhole environment.

11. The system of claim 9, further comprising a second fluidic pulser in fluid communication with the internal bore and a second acoustic oscillator, the second acoustic oscillator characterized by a second oscillation frequency different from the first oscillation frequency; and a surface receiver in fluid communication with the internal bore and including a first acoustic filter corresponding to the first oscillation frequency, and a second acoustic filter corresponding to the second oscillation frequency of the second acoustic oscillator.

* * * * *